United States Patent [19]

Hebert

[11] 4,033,409

[45] July 5, 1977

[54] WELL TUBING MANDREL WITH ORIENTING SLEEVE WITH TRASH RELIEVING SLOT

[75] Inventor: Gerald P. Hebert, Lafayette, La.

[73] Assignee: Production Specialties, Inc., Lafayette, La.

[22] Filed: Sept. 13, 1976

[21] Appl. No.: 722,520

[52] U.S. Cl. ..... 166/117.5

[51] Int. Cl.[2] ..... E21B 23/00

[58] Field of Search ..... 166/117.5

[56] References Cited

UNITED STATES PATENTS

| | | | |
|---|---|---|---|
| 2,942,671 | 6/1960 | Schramm | 166/117.5 |
| 2,948,341 | 8/1960 | Fredd | 166/117.5 |
| 2,988,146 | 6/1961 | Fredd | 166/117.5 |
| 3,353,607 | 11/1967 | Kinley | 166/117.5 |
| 3,827,490 | 8/1974 | Moore, Jr. et al. | 166/117.5 |

*Primary Examiner*—James A. Leppink
*Attorney, Agent, or Firm*—Jack W. Hayden

[57] ABSTRACT

A mandrel for use in the well tubing in which the mandrel has an open bore for alignment with the well tubing and a side pocket offset from the open bore for receiving flow control devices and an orienting sleeve in the open bore above the pocket for aligning a flow control device to be positioned in the pocket. The orienting sleeve includes an elongated hollow tubular body with a lower end which tapers upwardly and away from the offset pocket to form a guide surface and a first longitudinally extending slot extends from the highest portion of the tapered guide surface and terminates in spaced relation to the upper end of the sleeve. A second slot of relatively narrow width in relation to the first slot extends from the termination of the first slot to the upper end of the tubular body to form spaced aligned shoulders at the juncture of the first and second slot and a passage way for relieving or discharging trash and debris from the first slot into the well tubing.

2 Claims, 4 Drawing Figures

WELL TUBING MANDREL WITH ORIENTING SLEEVE WITH TRASH RELIEVING SLOT

SUMMARY OF THE INVENTION

Side pocket mandrels are well known and have been used for many years in tubing strings in oil and gas production. They include a main bore which aligns with the tubing as well as an offset portion which provides a valve receiving pocket so that a flow control device can be positioned in the offset portion to control flow from a producing formation and into the well string to the earth's surface. The offset arrangement enables other tools to be run through the tubing string without the necessity of removing the flow control devices in the valve receiving section.

Where a well is oriented or drilled in a deviated direction, some difficulty may be encountered in aligning and positioning a flow control device in the offset valve receiving portion of the mandrel. Orienting sleeves with a closed end slot such as shown in U.S. Pat. No. 3,610,336 have been heretofore employed to orient or align a flow control device to enable it to be positioned in the offset valve pocket.

It can be appreciated that well fluids sometimes include foreign matter as well as paraffin which may tend to solidify in the well tubing during production. Such foreign matter and paraffin may tend to collect in or around the slot in the orienting sleeve in a manner which might render it ineffective for its intended function.

A primary object of the present invention is to provide a slotted orienting sleeve in a well mandrel which is constructed and arranged to enable any trash or debris which may tend to collect in the slot to be relieved or discharged into the tubing.

Still another object of the present invention is to provide an orienting sleeve for use with a well tubing mandrel that is provided with a trash relief slot to enable debris and foreign objects to be discharged from the sleeve to reduce the likelihood of malfunctioning of the sleeve as an orienting means for aligning the well control device to be positioned in the offset valve pocket of the mandrel.

Other objects and advantages of the present invention will become more readily apparent from a consideration of the following drawings and description.

DESCRIPTION OF THE PREFERRED EMBODIMENT

Figure 1:
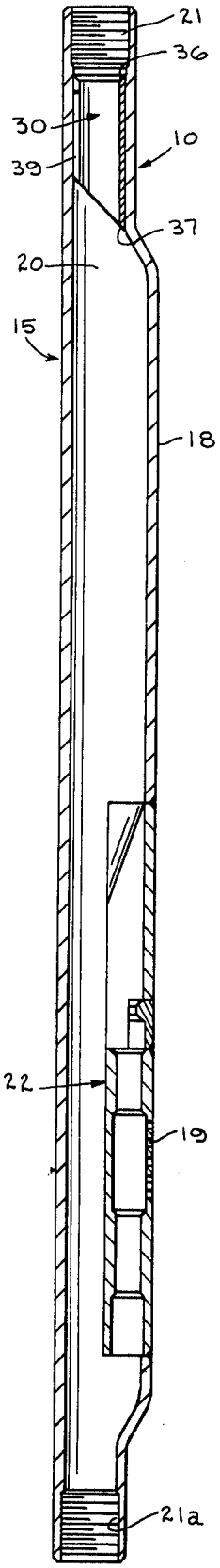
FIG. 1 is a longitudinal sectional view illustrating the orienting sleeve of the present invention employed with a mandrel having an offset valve receiving portion.
Figure 3:
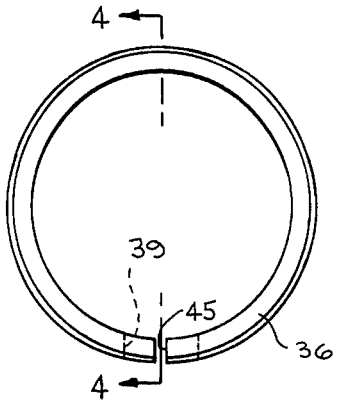
FIG. 3 is a top plan view of the orienting sleeve.

Attention is first directed to FIG. 1 of the drawings wherein the mandrel of the present invention is referred to generally by the numeral 10 and is shown as including a body referred to generally at 15. The body is generally tubular in configuration and is provided with an offset portion 18 which forms a bulge or an enlargement along one side of the mandrel 10. The enlargement 18 includes a valve receiving pocket 22 to enable a flow control device to be positioned in the offset 18 so that flow through the ports 19 of the mandrel to the tubing string may be controlled as desired.

The mandrel 10 includes a main bore 20 which extends longitudinally thereof to enable various well tools to be run through the tubing without interfering with the valve in the valve pocket 22 formed in the enlargement 18. Suitable threads 21 and **21*a* are provided at each end of the mandrel 10** to enable it to be connected into the tubing string.

An orienting sleeve 30 is provided at the upper end of the mandrel to enable a flow control device to be aligned so that it can be positioned in the pocket 22 formed in the enlargement 18.

Figure 2:
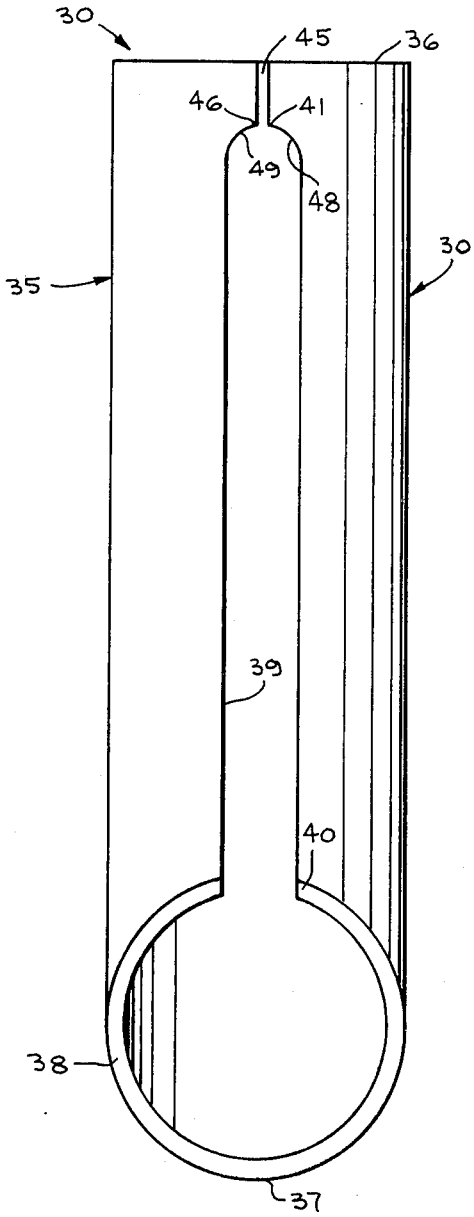
FIG. 2 is an enlarged view illustrating the preferred form of the slot arrangement of the present invention.
Figure 4:
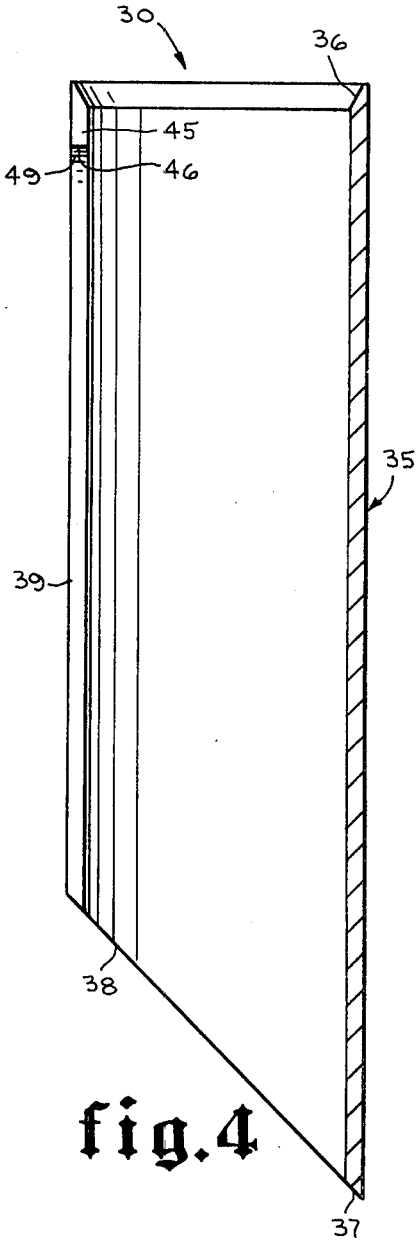
FIG. 4 is a sectional view on the line 4—4 of FIG. 3.

The orienting sleeve 30 is shown in greater detail in FIG. 2 and includes an elongated hollow tubular body 35 having an upper end 36 and a lower end 37. The lower end 37 extends at an angle relative to the longitudinal axis of the hollow tubular body to provide a sloping guide surface 38. A positioning tool of well known configuration is lowered into the tubing with a flow control device thereon and when the tool is positioned beneath the sleeve 30 and then elevated, a portion thereof engages the guide surface 38. As the tool moves up the guide surface 38 it rotates to align with the enlargement 18 and moves along slot 39 to abut shoulders 48, 49 so that the flow control device supported by the tool may be deposited in valve pocket 22 in a manner well known in the art.

It is to be noted that the slot 39 is angularly positioned relative to the offset 18 in a predetermined manner. Also, the guide surface 38 slopes upwardly and away from the offset 18 in mandrel 10 as shown in the drawings. The slot 39 extends from the highest portion 40 of the guide surface 38 longitudinally of the hollow tubular body 35 to terminate as represented at 41 in spaced relation to the upper end 36.

A second slot 45 extends from the upper end 41 of the first slot 39 and intersects the upper end 36 of the hollow tubular body 35. It will be noted that the second slot 45 is of relatively narrow width in relation to the width of the first slot 39 as illustrated in the drawings and its juncture as represented at 46 with the upper end of 41 of the first slot 39 forms aligned shoulder means 48 and 49 at the upper end of the first slot 39 which are spaced by the width of the second slot 45.

The spaced shoulders 48 and 49 provide an abutment for engagement with a projection carried by the kick-over or positioning tool so that the kick-over tool can be properly positioned relative to the valve pocket 22 for positioning a flow control device therein.

It can be appreciated that where a well bore is oriented or drilled at an angle, tools will normally seek the low side of the tubing as they move therethrough. Thus, the orienting sleeve enables a flow control device, such as a valve to be aligned with the pocket 18 for positioning in the valve receiving section 22, regardless of the angular relationship of the mandrel 10 in the well bore.

Also, it can be appreciated that any sediment, debris, trash and paraffin that might tend to settle out of the producing well would also normally seek the low side of a hole, and possibly tend to collect in the slot 39. Where the shoulder of the prior art orienting sleeves is continuous, it can be appreciated that there is less likelihood for the debris, trash and paraffin to move out of such slot, so that possible interference with the orientation and positioning of a flow control device in the offset pocket 18 may be encountered. The present invention provides an arrangement which assists in overcoming this in that the second slot 45 intersects the first slot 39 at its upper end and as fluid flow occurs through the tubing, it can be appreciated that any debris, trash, sediment or paraffin that might otherwise tend to fill the slot 39 is permitted to flow or to be discharged therefrom through the slot 45 and into the tubing.

Also, it can be appreciated that the width of the second slot 45, as shown in the drawings, is relatively narrow in relation to the width of the first slot 39. As shown in the drawings, the width of the second slot 45 is only about one-sixth or one-seventh of the first slot so that while spaced shoulder means 48 and 49 are provided, trash or debris may be discharged from adjacent such shoulder means 48 and 49 through the second slot 45 and into the tubing.

This arrangement tends to inhibit malfunctioning of the orienting device that might otherwise occur should debris, trash or other foreign material settle in the slot 39 and more particularly either fill the slot 39 or settle in the slot adjacent the shoulders 48 and 49 so as to inhibit proper positioning and alignment of the flow control device with the offset pocket 18 of the mandrel.

It can also be appreciated that mandrels 10 are positioned at longitudinally spaced intervals throughout the well tubing string, with each member being identical and each including the orienting sleeve 30 and the offset pocket 18 for receiving flow control devices therein to control flow from the well bore in a desired manner.

The foregoing disclosure and description of the invention are illustrative and explanatory thereof, and various changes in the size, shape, and materials as well as in the details of the illustrated construction may be made without departing from the spirit of the invention.

What is claimed is:

1. In a mandrel for use in a well tubing in which the mandrel body has an open bore for alignment with the well tubing and a pocket offset from the open bore for flow control devices, the invention comprising:

a. an orienting sleeve in the open bore above the pocket for aligning a flow control device to be positioned in the pocket, said orienting sleeve including:

1. an elongated hollow tubular body having an upper and lower end;
2. said lower end extending upwardly at an angle relative to the longitudinal axis of said tubular body to form a sloping guide surface which extends upwardly and away from the offset pocket;
3. a first slot extending longitudinally of said tubular body from the highest portion of said guide surface, said first slot terminating in spaced relation to said upper end of said tubular body;
4. a second slot extending from the upper end of said first slot to the upper end of said tubular body; and
5. said second slot being substantially smaller in width than said first slot to form a pair of aligned shoulders at the juncture of said first and second slot which are spaced from each other by said second slot whereby debris may discharge from said first slot through said second slot and into the tubing.

2. A well installation comprising:

a. a well tubing having a plurality of identical mandrels each having an open bore for alignment with the well tubing and a pocket offset from the open bore for receiving flow control devices;

b. an orienting sleeve in the open bore above the pocket of each mandrel for aligning a flow control device to be positioned in the pocket, each sleeve of each mandrel including;

1. an elongated hollow tubular body having an upper and lower end;
2. said lower end extending upwardly at an angle relative to the longitudinal axis of said tubular body to form a sloping guide surface which extends upwardly and away from the pocket;
3. a first slot extending longitudinally of said tubular body from the highest portion of said guide surface, said first slot terminating in spaced relation to said upper end of said tubular body;
4. a second slot extending from the upper end of said first slot to the upper end of said tubular body; and
5. said second slot being substantially smaller in width than said first slot to form a pair of aligned shoulders at the juncture of said first and second slot which are spaced from each other by said second slot whereby debris may discharge from said first slot through said second slot and into the tubing.

* * * * *